United States Patent [19]

Turner

[11] Patent Number: 4,825,425

[45] Date of Patent: Apr. 25, 1989

[54] PARKING METER RESET DEVICE

[75] Inventor: Paul Turner, New Ross, Ind.

[73] Assignee: Midas Gate International, Inc., Jacksonville, Fla.

[21] Appl. No.: 156,868

[22] Filed: Feb. 18, 1988

Related U.S. Application Data

[63] Continuation-in-part of Ser. No. 935,487, Nov. 26, 1986, abandoned.

[51] Int. Cl.[4] ..... G04F 8/00

[52] U.S. Cl. ..... 368/7; 368/90

[58] Field of Search ..... 368/7, 8, 10, 90

[56] References Cited

U.S. PATENT DOCUMENTS

| | | | |
|---|---|---|---|
| 3,150,754 | 9/1964 | Greene et al. | 368/7 |
| 3,324,647 | 6/1967 | Jedynak | 368/7 |
| 3,999,372 | 12/1976 | Welch et al. | 368/7 |
| 4,043,117 | 8/1977 | Maresca et al. | 368/7 |

*Primary Examiner*—Bernard Roskoski

*Attorney, Agent, or Firm*—Antonelli, Terry & Wands

[57] ABSTRACT

A parking meter reset device includes an infra-red radiation transmitter element slidably positioned within a transmitter module and an infra-red radiation detector element positioned within a cavity in a detector module. The modules are within a housing adapted for mounting on a parking meter pole so that the detector element is directed downwardly from 5° to 10° below horizontal and the transmitter element is directed downwardly at an angle about 5° less than the downward angle of the detector element. This minimizes detection of stray radiation such as from sunlight. An edge of a first window, positioned in front of the transmitter module, abuts an edge of a second window, in front of the detector module. A portion of the radiation transmitted into the first window is refracted through the abutting edges into the second window. If either window is blocked, refracted radiation causes the parking meter to function like a non-resetting meter. The transmitter and receiver circuitry draws power only during brief pulses occurring at greater intervals, minimizing power requirements.

15 Claims, 3 Drawing Sheets

OPT. COUP.
PULSE GENERATOR
OSCILLATOR
AMP.

PARKING METER RESET DEVICE

CROSS REFERENCE TO RELATED APPLICATIONS

This application is a continuation-in-part of U.S. patent application Ser. No. 935,487 filed Nov. 26, 1986 now abandoned.

BACKGROUND OF THE INVENTION

The present invention pertains to a reset device for a parking meter. More particularly, the present invention pertains to an infra-red radiation and receiving device, having minimum power requirements, for erasing any parking time remaining on a parking meter and resetting the parking meter when a vehicle parked in the space controlled by the parking meter has left, leaving the space empty. The parking meter reset device of the present invention is provided with a housing minimizing detection of stray radiation, such as from ambient sunlight, which could interfere with proper operation of the device. The housing is constructed to assure that, should someone attempt to thwart operation of the parking meter by blocking the transmission or reception of the radiation, only the reset device would be disabled, and the parking meter itself would continue to operate, functioning as a non-resettable parking meter.

Parking meters are frequently utilized to control parking spaces, particularly in urban areas. In the usual arrangement, each parking space has a parking meter assigned to it, and when a driver parks his car in that space, the driver is then to insert one or more coins into the parking meter and turn a control knob to actuate the parking meter. The parking meter then times a preset period of time, the length of which may be dependent upon the amount of money inserted by the driver, following which the parking meter indicates that the time for which payment was made has expired and generally displays a violation flag or other unpaid time indicator to indicate that there is no paid parking time remaining on the parking meter, and so if a vehicle is parked there, then the vehicle has not paid for the parking time or has been parked for a greater time than has been paid for. A police officer or a meter attendant then can cite the vehicle for a parking violation. Parking meters used in this fashion encourage a turnover of parking spaces, enabling more motorists to find a parking space, and provide revenue for the local government.

It often happens that a driver will park in a parking space and pay to park for a period of time, such as an hour, but will finish the business which has brought him to that location in a shorter time and so will leave the parking space with time remaining on the parking meter. A second motorist might then park in that parking space without paying, instead using some or all of the balance of the time from the first motorist. This is inequitable in that the second motorist is obtaining parking for which he is not paying. In addition, it deprives the local government of revenue that it might otherwise collect. To overcome this, parking meter reset devices have been developed which detect the absence of a vehicle in the parking space and reset the parking meter, returning display of the unpaid time indicator. By way of example, U.S. Pat. No. 3,018,615 shows a parking meter including a device which magnetically or electronically detects the presence or absence of a vehicle in the assigned parking space, and upon removal of the vehicle from the parking space and arrival of a subsequent vehicle, resets the parking meter. Likewise, U.S. Pat. No. 3,324,647 shows a parking meter including a proximity detector which resets the parking meter time indicator when the vehicle in the assigned parking space is removed.

U.S. Pat. No. 3,999,372 discloses a parking meter with a sonic transmitter and receiver for resetting the meter when the parked car is removed. The transmitter is shut off for a brief period following each pulse to enable reception of the reflected sonic pulse without confusion with the transmitted sonic energy. U.S. Pat. No. 3,535,870 shows a parking meter controller which transmits periodic bursts of ultrasonic energy and a receiver for receiving such energy after reflection from a vehicle in the controlled parking space. If the vehicle departs, the absence of reflections causes the parking meter to reset and deactivates the controller until the operator of the next parked vehicle reactivates the parking meter, thereby reducing power consumption. Other such resetting parking meters are shown in, for example, U.S. Pat. Nos. 2,535,472, 2,575,650, 2,652,551, 2,945,341, 3,018,615, 3,114,128, 3,141,292, 3,150,754, 3,166,732, 3,194,005, 3,154,175, 3,930,363, 4,043,117, 4,183,205, and No. 29,511.

Many of these prior art resetting devices utilize a sonic transmitter or a light transmitter located on the parking meter or its pole. The radiation from the transmitter is reflected by the vehicle in the parking space and is detected by a compatible detector also located on the parking meter or pole. When the detector does not receive a reflected signal for at least a preset time, it resets the parking meter. A problem experienced by prior art parking meter reset devices which detect reflected radiation, whether sonic or light, is the detection of erroneous radiation which prevents the device from resetting when it should. Thus, for example, ambient sonic or ultrasonic radiation can be detected by sonic devices which, therefore, do not reset even when no vehicle is in the controlled parking space. Likewise, sunlight, or possibly even a nearby street light, can be detected by devices utilizing light radiation, again resulting in the device not resetting even though the parked vehicle has left the controlled parking space. Another problem which can be experienced by prior art parking meter reset devices is failure to operate properly when the radiation path is blocked between the device and the parking space. Thus, for example, a bicycle may be parked and locked to the parking meter pole with a part of the bicycle or of the lock against the radiation transmitter and receiver, blocking the radiation path. Alternatively, a prankster might cover over the transmitter or the receiver, or both, in an attempt to prevent the device from receiving reflected radiation in the expectation that this would cause the parking meter always to show that the paid time had expired. A motorist doing this might then put a note on the parking meter saying the meter was not working properly and argue that this justified not paying for parking, or that payment had been made but the parking meter was inoperative.

SUMMARY OF THE INVENTION

The present invention is a reset device for a parking meter which minimizes the sensitivity of the device to ambient radiation and which permits normal parking meter operation when the radiation path is blocked. The parking meter generally has a violation flag or other unpaid time indicator, a timer for timing a preselected period of time for a vehicle to remain parked in the parking space to which the parking meter is assigned, and a coin responsive actuator for deactivating the unpaid time indicator and actuating the timer for a period of time selected in accordance with the coins utilized to initiate operation of the actuator, following which the unpaid time indicator is actuated. The reset device of the present invention is also activated by the coins inserted into the parking meter and includes a timing circuit for generating timing pulses of a first, brief duration at a pulse interval of a second, longer duration, a transmitter responsive to the pulses from the timing circuit for transmitting a radiation signal from the parking meter toward the parking space, a receiver enabled by the timing circuit pulses to receive the transmitted signal after reflection thereof from a vehicle parked in the parking space, and a controller connected to the receiver and responsive to passage of a time interval greater than the second duration without the receiver receiving the transmitted signal for actuating the parking meter unpaid time indicator, terminating operation of the parking meter timer and deactivating the reset device.

The transmitter and the receiver of the parking meter reset device are within a housing that preferably is mounted on the parking meter pole. The transmitter is positioned to transmit its radiant energy in a direction generally below horizontal, but not in a focused beam. The receiver is directed slightly more below horizontal than is the transmitter, but again is not sharply focused. This slight downward angling minimizes the likelihood of reception of ambient radiation. The lack of sharp focussing permits the radiation to be detected after reflection from any of the irregular surfaces of a vehicle parked in the controlled parking space. Preferably, the radiation transmitter is an infra-red transmitter and the radiation detector is an infra-red detector. Preferably, also, the detector is positioned within a recess in the housing with the sensitive surface of the detector thus recessed from the housing surface, for example by a distance in the order of about 0.7 inches, thereby further shielding the detector from ambient light.

The housing includes a first radiation-transparent window, of for example plastic such as Plexiglas, covering the transmitter and a second radiation-transparent window of similar material covering the detector. The detector window has an edge abutting a corresponding edge of the transmitter window. A portion of the transmitted radiation entering the transmitter window is defracted to these edges through which it passes to enter the detector window. This defracted radiation is again defracted with a part of it passing to the detector and a part of it passing toward the parking space. Under normal conditions the amount of defracted radiation thus reaching the detector is insufficient to prevent actuation of the controller. However, the radiation reflected from a vehicle parked in the controlled space does prevent actuation of the controller. If an object is blocking the transmitter window, then much of the radiation which ordinarily would be transmitted toward the controlled parking space is reflected back toward the transmitter which re-reflects it into the transmitter window. As a result of such repeated reflection, an increased amount of the radiation is refracted through the edges of the transmitter and detector windows and into the detector window, increasing the amount of refracted radiation reaching the detector to an amount preventing actuation of the controller. Likewise, if the detector window is blocked, refracted radiation directed through the detector window towards the parking space is reflected, and so an increased amount of the refracted radiation reaches the detector, again preventing actuation of the controller. Likewise, if both windows are blocked, sufficient radiation reaches the detector to prevent actuation of the controller.

BRIEF DESCRIPTION OF THE DRAWINGS

These and other aspects and advantages of the present invention are more apparent in the following detailed description and claims, particularly when considered in conjunction with the accompanying drawings in which like parts bear like reference numerals. In the drawings:

DETAILED DESCRIPTION OF PREFERRED EMBODIMENTS

Figure 1:
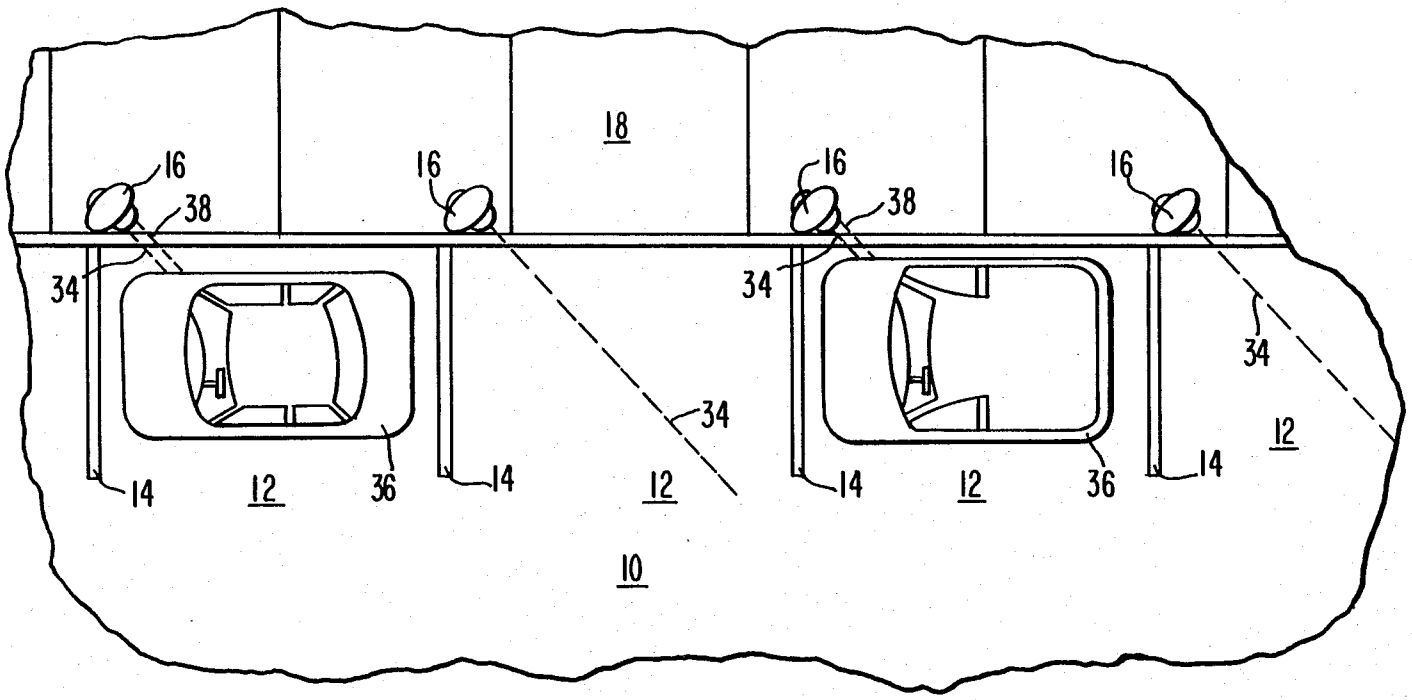
FIG. 1 is a fragmentary plan view illustrating a group of parking spaces provided with parking meters having reset devices therewith in accordance with the present invention.

FIG. 1 depicts a street 10 along the edge of which several parking spaces 12 are marked by lines 14 which, by way of example, might be painted on the pavement of street 10. A parking meter 16 is assigned to each parking space 12 and might be positioned at the edge of the sidewalk 18 near the front of each space 12, as illustrated in FIG. 1.

Figure 2:
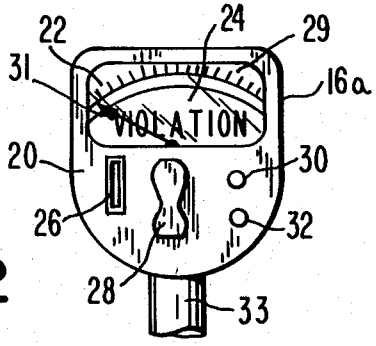
FIG. 2 is a fragmentary elevational view of a first embodiment of a parking meter and pole incorporating a reset device in accordance with the present invention.

FIG. 2 illustrates a mechanical parking meter **16*a* mounted on a pole 33. In conventional manner, the mechanical parking meter 16*a* includes a housing 20 having a window 22 in the upper portion thereof. Within the window 22 a violation flag 24 is visible when the parking meter 16 is not timing a parking interval for which payment has been made. A coin receiving slot 26 is provided in housing 20. When a driver wishes to make payment for parking time, the driver inserts one or more coins in the slot 26 and then rotates knob 28 to actuate the parking meter. Violation flag 24 is then withdrawn within housing 20, and the dial 29 of parking meter 16*a* is then visible, as is an indicator 31** which indicates the remaining parking time for which payment has been made.

Parking meter **16*a* is provided with a transmitter element 30 and a receiver element 32 for transmitting and receiving radiant energy, which preferably is infrared radiation. Rather than being on parking meter 16*a*** itself, transmitter element 30 and receiver element 32 can be mounted on pole 33, if desired. As seen in FIG. 1, radiant energy from transmitter element 30 is transmitted generally in a path 34 toward the parking space 12 to which the parking meter 16 is assigned. If a vehicle 36 is parked in the parking space, then when the radiant energy reaches the vehicle a portion of the radiant energy is reflected back to parking meter 16 generally in a reflection path 38. Reflected energy within path 38 is detected by receiver element 32 on parking meter 16. However, if no vehicle is parked in the assigned parking space, then no radiant energy is reflected back to parking meter 16.

Figures 3, 4:
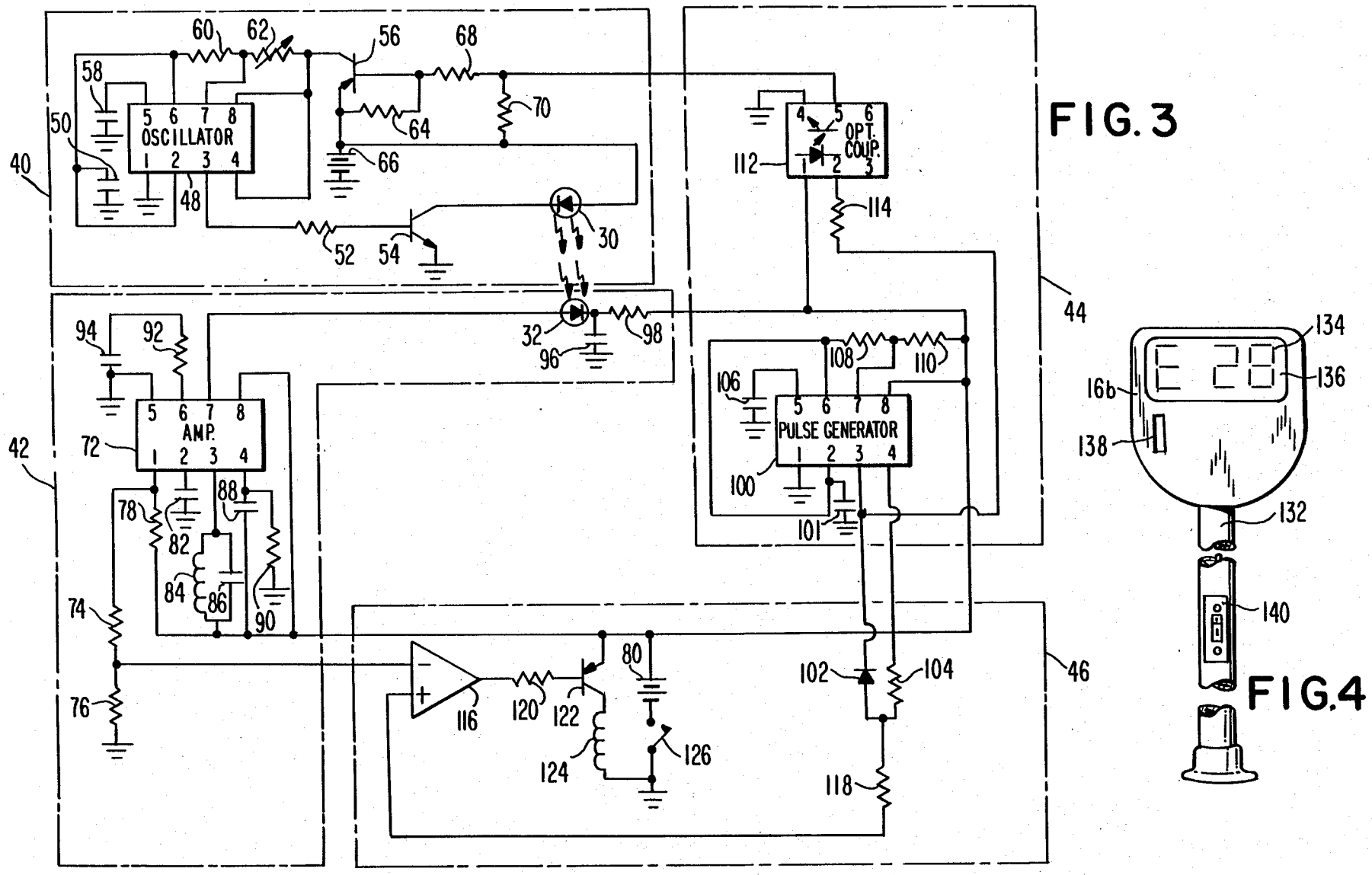
FIG. 3 is a schematic diagram of circuitry suitable for incorporation into a parking meter reset device in accordance with a preferred embodiment of the present invention.
FIG. 4 is a fragmentary front elevational view of another embodiment of a parking meter and pole with a reset device in accordance with the present invention.

FIG. 3 depicts circuitry suitable for use in the reset device of the present invention, including a transmitter circuit 40, a detector circuit 42, a timer circuit 44, and a controller circuit 46. Transmitter circuit 40 includes an oscillator 48 which by way of example can be implemented by an appropriately connected TLC 555 timer circuit. Thus, oscillator 48 has its pin no. 1 tied to ground, its pins nos. 2 and 6 tied together and coupled to ground through capacitor 50, its pin no. 3 coupled through resistor 52 to the base of NPN transistor 54, the emitter of which is tied to ground, and its pin no. 4 tied to the collector of PNP transistor 56. Pin no. 5 of oscillator 48 is coupled through capacitor 58 to ground, while pin no. 6 is coupled through the serial combination of fixed resistor 60 and variable resistor 62 to the collector of transistor 56. Pin no. 7 of oscillator 48 is connected to the junction of resistors 60 and 62, and pin no. 8 is tied to the collector of transistor 56.

The emitter of transistor 56 is tied to the positive terminal of battery 66, the negative terminal of which is tied to ground. The base of transistor 56 is coupled to the positive terminal of battery 66 by resistor 64 and also by the serial combination of resistors 68 and 70. Transmitter element 30 is coupled between the positive terminal of battery 66 and the collector of transistor 54. As illustrated in FIG. 3, preferably transmitter element 30 is a light transmitting device such as a light emitting diode having its anode tied to battery 66 and its cathode tied to the collector of transistor 54. Alternatively, transmitter element 30 could be a sonic device, a laser diode, or another radiant energy transmitter.

Receiver circuit 42 includes a remote control amplifier 72 which, by way of example, might be an appropriately connected uPC 1373H bipolar analog integrated circuit. Thus, amplifier 72 has its pin no. 1, which is the circuit output, coupled through the serial combination of resistors 74 and 76 to ground and coupled through resistor 78 to the positive terminal of battery 80 within controller circuit 46. Pin no. 2 of amplifier 72 is coupled through capacitor 82 to ground, while pin no. 3 is coupled through the parallel combination of inductance coil 84 and capacitor 86 to the positive terminal of battery 80. Pin no. 4 of amplifier 72 is coupled by capacitor 88 to the positive terminal of battery 80 and is coupled by resistor 90 to ground. Pin no. 5 of amplifier 72 is tied to ground, while pin no. 6 is coupled to ground by the serial combination of resistor 92 and capacitor 94. Pin no. 7 of amplifier 72 is connected to one side of receiver element 32, the other side of which is coupled to ground by capacitor 96. As illustrated in FIG. 3, if transmitter element 30 is a light emitting diode, then receiver element 32 can be a photodiode having its anode tied to pin no. 7 of amplifier 72 and its cathode connected to capacitor 96. If transmitter element 30 is a sonic device, a laser diode, or some other radiant energy transmitter, then receiver element 32, of course, must be compatible. The junction of receiver element 32 and capacitor 96 is also coupled through resistor 98 to the positive terminal of battery 80. Pin no. 8 of amplifier 72 is tied to the positive terminal of battery 80.

Timer circuit 44 includes an interval timer or pulse generator 100, which, by way of example, might be an appropriately connected TLC 555 timer circuit. Thus, pulse generator 100 has its pin no. 1 tied to ground, its pin no. 2 coupled to ground through capacitor 101 and coupled through the serial combination of resistor 108 and 110 to the positive terminal of battery 80 within control circuit 46, and its pin no. 3 tied to the cathode of diode 102 within control circuit 46, the anode of which is coupled by resistor 104 to the positive terminal of battery 80. Pin no. 4 of pulse generator 100 is tied to the positive terminal of battery 80, while pin no. 5 is coupled by capacitor 106 to ground, and pin no. 6 is coupled through the serial combination of resistors 108 and 110 to the positive terminal of battery 80. Pin no. 7 is tied to the junction of resistors 108 and 110, and pin no. 8 is tied to the positive terminal of battery 80.

Timer circuit 44 also includes an optical coupler 112 which, by way of example, may be an appropriately connected VN 26 opto-isolator. Thus, optical coupler 112 has its terminal no. 1 connected to the positive terminal of battery 80 and its terminal no. 2 coupled through resistor 114 to pin 3 of pulse generator 100. Terminal no. 4 of optical coupler 112 is tied to ground, while terminal no. 5 is connected to the junction of resistors 68 and 70 within transmitter circuit 40. There are no connections to terminals nos. 3 and 6 of optical coupler 112. By way of example, within optical coupler 112 a light emitting diode may be connected between pins nos. 1 and 2 and a phototransistor may be connected between pins nos. 4 and 5. As a consequence, when pin no. 3 of pulse generator 100 goes to ground the junction of resistors 68 and 70 within transmitter circuit 40 is brought close to ground, turning on transistor 56.

Within control circuit 46, operational amplifier 116 has its positive input coupled through resistor 118 to the junction of diode 102 and resistor 104, its negative input tied to the junction of resistors 74 and 76 within receiver circuit 42, and its output coupled through resistor 120 to the base of PNP transistor 122. The emitter of transistor 122 is tied to the positive terminal of battery 80, while the collector of the transistor is coupled through the coil of solenoid 124 to ground. The negative terminal of battery 80 is connected to one contact of single-pole-single-throw switch 126, the second contact of which is tied to ground.

When parking meter 16 is not timing a parking interval and violation flag 24 is displayed, switch 126 within control circuit 46 is open. Therefore, battery 80 is cut off and optical coupler 112 is deenergized, cutting off transistor 56 within transmitter circuit 40. Thus, no power is available to oscillator 48, and so transistor 54 is cut off. As a consequence, light emitting diode 30 is deenergized. As a result, little or no current is drawn from either battery 66 or battery 80 during this quiescent condition, and so the battery lives of the two are extended.

When a driver parks in the associated parking space, inserts a coin in the meter 16, and operates control knob 28 to withdraw violation flag 24 and start the parking time interval, switch 126 is closed. Voltage from battery 80 then is applied to pulse generator 100. The output on pin no. 3 of pulse generator 100 is then a positive voltage with a series of negative pulses in it. When that output is positive, optical coupler 112 is cut off, since high voltage is applied to both its pin no. 1 and its pin no. 2. During the negative pulses from pulse generator 100, optical coupler 112 turns on transistor 56 within transmitter circuit 40. This permits voltage from battery 66 to be applied through transistor 56 to oscillator 48. Oscillator 48 has a frequency in the order of about 40Khz, and its output is applied through transistor 54 to energize transmitter element 30. Thus, transmitter element 30 emits a series of pulses having a repetition rate of 40,000 pulses per second, the duration of the pulse series and the interval between consecutive series are determined by pulse generation 100 within timer 44. For example, each series of pulses may have a duration of 100 milliseconds, and the consecutive series may be radiated at an interval of 30 seconds. The generator of a 0.1 second radiation pulse every 30 seconds. The generator of a 0.1 second radiation pulse every 30 seconds results in low power requirement and so long battery life. The 40 KHz radiation can be filtered from sunlight and other ambient radiation by a band pass filter, if desired.

The radiation from transmitter element 30 is reflected by the vehicle within the associated parking space and is detected by receiver element 32.

When the pin no. 3 output of pulse generator 100 is high and transmitter element 30 is not emitting radiation, receiver element 32 is not receiving any radiation, and so output terminal 1 of amplifier 72 applies a high voltage to the negative input of operational amplifier 116. However, at this same time, high voltage from battery 80 is coupled by resistors 104 and 118 to the positive input of operational amplifier 116. Consequently, the amplifier 116 output is high, cutting off transistor 122 and so keeping solenoid 124 deenergized.

When the pin no. 3 output of pulse generator 100 drops, the anode of diode 102 is approximately at a positive 1.2 volts. This voltage is applied through resistor 118 to the positive input of operational amplifier 116. At this same time, transmitter element 30 emits radiation and receiving element receives the reflected radiaion. The pin no. 1 output from amplifier 72 drops close to ground, and so a low voltage is applied to the negative input of operational amplifier 116. Consequently, operational amplifier 116 continues to apply a positive voltage to the base of transistor 122, and transistor 122 is maintained cut off, keeping solenoid 124 deenergized.

When the vehicle leaves the parking space, receiver element 32 no longer receives reflected radiation. As a consequence, the output on pin no. 1 of amplifier 72 remains high. During the intervals of high output from pin no. 3 on pulse generator 100, operational amplifier 116 continues to apply a high voltage to the base of transistor 122. When pin no. 3 of pulse generator 100 next goes low and the approximately 1.2 volts on the anode of diode 102 is applied through resistor 118 to the positive input of operational amplifier 116, the high output from pin no. 1 of amplifier 72, which is applied through resistor 74 to the negative input of the operational amplifier, results in operational amplifier 116 applying a low voltage to the base of transistor 122, turning on the transistor and energizing solenoid 124. Solenoid 124 pulls the escapement gear within the timing components of parking meter 16 out of mesh with other gears within that mechanism, which results in cancellation of the time remaining on the parking meter and return of violation flag 24 to its displayed position where it is visible through window 22. In addition, switch 126 is opened, shutting off the entire reset circuit. Thus, at the first negative pulse from pin no. 3 of pulse generator 100 after the vehicle has left the parking space, the remaining time on the parking meter is erased, the parking meter is reset, and the reset circuit returns to its quiescent condition.

During those portions of the timing interval of pulse generator 100 that its output pin no. 3 is at high voltage, little or no current is drawn by the remaining components of the circuitry. As a consequence, the drain on batteries 66 and 80 is minimized, prolonging battery life. Optical coupler 112 is utilized to electrically isolate transmitter 40 from receiver 42. This assures that crosstalk on the battery lines does not cause improper operation of receiver 42. The use of separate batteries to provide power for the transmitter and for the receiver also aids in this.

A parking meter reset device in accordance with the present invention has been implemented. The following table sets forth the identification of the various components within the circuitry of FIG. 3 in that implementation.

| Component | Identification |
|---|---|
| Diode 30 | Three SE 307 LEDs in parallel |
| Diode 32 | FSH 205 |
| Oscillator 48 | TLC 555 Timer |
| Capacitor 50 | 390 pf |
| Resistor 52 | 51 ohm |
| Transistor 54 | TIP 31 |
| Transistor 56 | 2N 3638 |
| Capacitor 58 | .001 uf |
| Resistor 60 | 33K ohm |
| Variable resistor 62 | 10K ohm variable resistor and 3.3 ohm fixed resistor in series |
| Resistor 64 | 10K ohm |
| Battery 66 | 6 Volt |
| Resistor 68 | lK ohm |
| Resistor 70 | 10K ohm |
| Amplifier 72 | uPC 1373 remote control amplifier |
| Resistor 74 | 22K ohm |
| Resistor 76 | 100K ohm |
| Resistor 78 | 100K ohm |
| Battery 80 | 11.2 Volt |
| Capacitor 82 | .033 uf |
| Coil 84 | 5 mh |
| Capacitor 86 | .0033 uf |
| Capacitor 88 | 10 uf |
| Resistor 90 | 150K ohm |
| Resistor 92 | 22 ohm |
| Capacitor 94 | 4.7 uf |
| Capacitor 96 | 10 uf |
| Resistor 98 | 1K ohm |
| Pulse generator 100 | TLC 555 Timer |
| Capacitor 101 | 100 uf |
| Diode 102 | Two lN914 diodes in series |
| Resistor 104 | 10K ohm |
| Capacitor 106 | .01 uf |
| Resistor 108 | lK ohm |
| Resistor 110 | 330K ohm |
| Optical Coupler 112 | VN 26 |
| Resistor 114 | 1.5K ohm |
| Operational amplifier 116 | TL082 |
| Resistor 118 | 10K ohm |
| Resistor 120 | 820 ohm |
| Transistor 122 | TIP32 |

FIG. 4 depicts an alternative form of parking meter **16*b* with a reset device in accordance with the present invention. Parking meter 16*b*, which is mounted on pole 132, is an electronic parking meter having a digital display 134 visible through its window 136. Digital display 134 includes a plurality of numerical indicators, such as seven-segment display indicators, to indicate the remaining paid parking time, for example the number of remaining paid minutes, if two numerical indicators are provided or the number of remaining paid hours and minutes, with a symbol such as a colon separating hours from minutes, if three numerical indicators are provided. As depicted in FIG. 4, display 134 preferably also has the capability of displaying a further indicator to indicate that the paid time has expired. This could be an indicator "E" for "expired," as in FIG. 4, or any other indicator, such as "V" for "violation" or "O" for "overtime." Alternatively, another type of violation indication could be provided such as energizing a large red indicator visible through window 136. The timer within electronic meter 16*b* can continue to count time after the time expired indicator is activated, permitting meter 16** to indicate the duration of the unpaid parking. Then, if the overtime parking fine increases as the duration of the overtime violation increases, a police officer or meter attendant can indicate the duration of the overtime violation on the parking ticket or violation notice so that the amount of the fine can be determined.

Parking meter **16*b* has a slot 138 for insertion of coins or a credit card to actuate the meter. The electronic nature of parking meter 16*b* permits the meter to be set by the coin or credit card, if desired, so that a control knob is unnecessary, although a control knob could be utilized if desired. In the absence of a control knob, the control circuit 46 of FIG. 3 is modified by making switch 126 an electronic switch controlled by transistor 122 and by replacing solenoid 124 with the reset circuitry for digital display 134** and the activating circuitry for the time expired or violation indicator.

Figure 6:
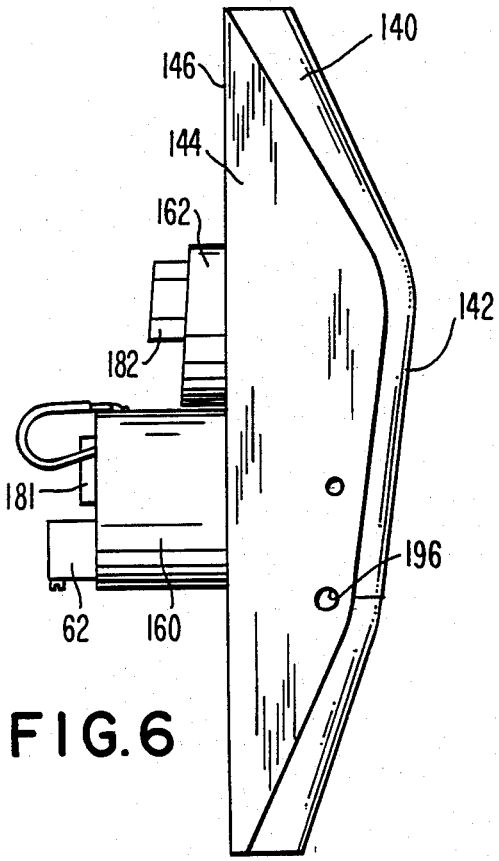
FIG. 6 is a side elevational view of the reset device of FIG. 5.
Figure 5:
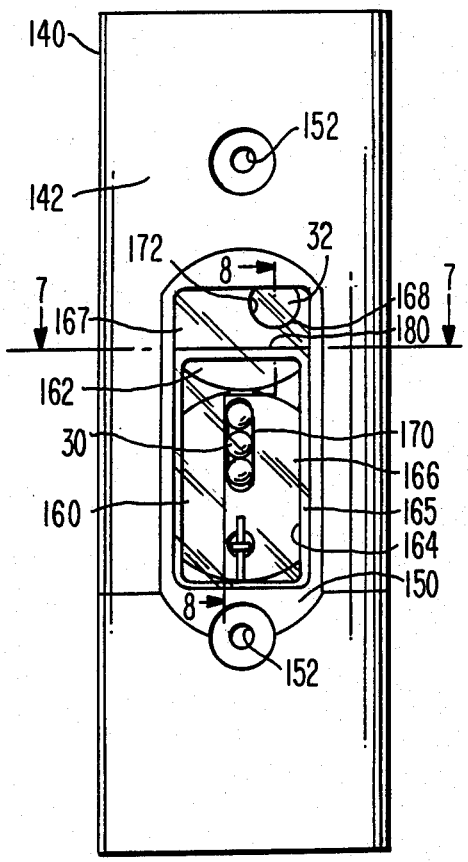
FIG. 5 is a front elevational view of a preferred embodiment of a reset device in accordance with the present invention.
Figure 7:
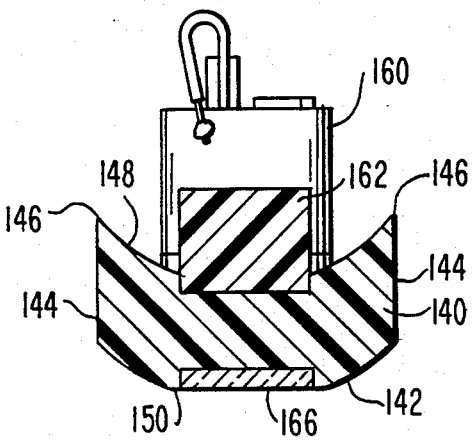
FIG. 7 is a sectional view taken along line 7—7 of FIG. 5.

A housing 140 is mounted on pole 132 and houses an infra-red radiation transmitter and an infra-red radiation receiver and associated circuitry. Housing 140 and the detailed construction of the radiation transmitter and radiation receiver can be utilized with either a mechanical parking meter **16*a* or an electronic parking meter 16*b* in accordance with the present invention. As depicted in FIGS. 5, 6, and 7, housing 140 includes a front panel 142 and side panels 144 which terminate in edges 146 on either side of an open rear 148. Housing 140 includes mounting holes 152, permitting mounting of the housing pole 132. When housing 140 is mounted on pole 132, side edges 146 preferably are substantially vertical. Front panel 142 slopes inwardly, being further from side edges 146 and pole 132** at the top of the front panel than at the bottom. This slope is preferably in the order of from about 5° to about 10° from vertical.

Figure 8:
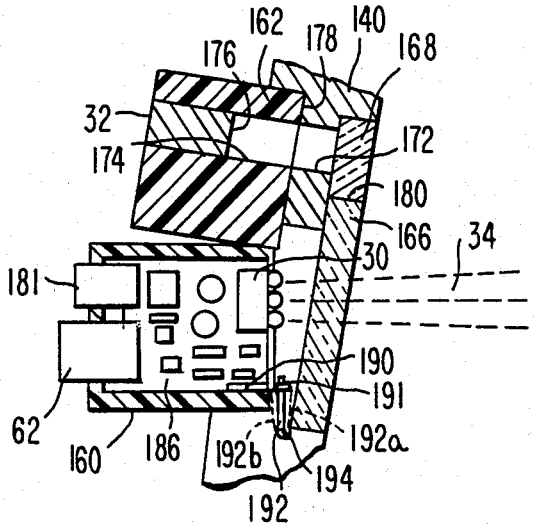
FIG. 8 is a fragmentary sectional view taken along line 8—8 of FIG. 5.

An infra-red radiation transmitter module 160 and an infra-red radiation detector module 162 are mounted in housing 140, extending from the open rear 148 thereof. Front panel 142 of housing 140 includes a planar portion 150 having an opening 164 therethrough. Opening 164 includes an offset 165 which seats a transmitter window 166 in front of transmitter module 160. As seen in FIG. 8, the upper edge of offset 165 extends upwardly to form a seat 167 over detector module 162, and a detector window 168 is positioned on seat 167 in front of detector module 162. The upper edge of transmitter window 166 and the lower edge of detector window 168 abut at junction 180. These edges closely mate and preferably are straight and smooth, and no adhesive is placed between them so that good contact is made between windows 166 and 168, permitting passage of refracted radiation through junction 180 from transmitter window 166 into detector window 168.

Transmitter module 160 includes infra-red transmitter element 30, depicted in FIG. 5 as formed of three SE307 light emitting diodes which project through opening 170 in the front surface 178 of transmitter module 160. Radiation from transmitter element 30 passes through transmitter window 166 along transmission path 34 of FIG. 1. Detector module 162 includes an infra-red detection element 32 which, as seen in FIG. 8, is positioned within a cavity 174 within detector module 162. An opening 172 passes through seat 167 in coincidence with cavity 174 so that infra-red radiation in reflection path 36 of FIG. 1 which passes into housing 140 through detector window 168 and enters opening 172 and cavity 174 then reaches infra-red sensitive surface 176 of detector element 32. The thickness of seat 167 and the depth of cavity 174 position the infra-red sensitive surface 176 of detector element 32 in the order of about 0.7 inch from the front surface 142 of housing 140, thereby shielding surface 176 from ambient light in the vicinity of housing 140.

As seen particularly in FIG. 6, transmitter module 160 is provided with a connector 181, and detector module 162 is provided with a connector 182. Preferably, both transmitter module 160 and detector module 162 are shielded to prevent cross-talk and stray electromagnetic radiation from interfering with proper operation. Only the circuitry of transmitter module 40 of FIG. 3 is within transmitter module 160, and connector 181 includes connection pins for the positive terminal of battery 66, the connection between pin no. 5 of optical coupler 112 and the junction of resistors 68 and 70, and the shield and ground. Only detector element 32 is within detector module 162, and connector 182 includes connection pins for each side of detector element 32 and for the shield. Preferably the connectors 181 and 182 have different numbers of pins to prevent incorrect connections. Thus, one of the connectors could have four pins, with two tied to ground or with one not utilized. The remaining components of detector circuit 42 and the components of timer circuit 44 and controller circuit 46 are positioned within the housing of parking meter 16. Connectors 181 and 182 connect the circuitry within housing 140 to the remaining circuitry within the housing of parking meter 16 by separately shielded cables, such as a highly shielded Teflon coaxial cable. If desired, transmitter module 160 can contain only transmitter element 30, with the remaining components of transmitter circuit 40 also being within the housing of meter 16; however, this may require cable shielding so thick that it cannot pass through the mechanical connections required to mount parking meter 16 on its pole. Preferably, a drain opening 184 is provided through each side panel 144 of housing 140 to prevent accumulation of condensation within the housing.

FIG. 8 illustrates the relationship of transmitter module 160 and detector module 162 with transmitter window 166 and detector window 168 and the positioning of these components within housing 140. Windows 166 and 168 preferably have a thickness of from about 0.1 mm to about 8 mm. Front surface 178 of detector module 162 abuts the rear surface of seat 167 and is substantially parallel with the inner surfaces of detector window 168 and transmitter window 166, being spaced in the order of about one-fourth inch behind the windows, with cavity 174 aligned with opening 172 so that infrared radiation passing through detector window 168, opening 172 and cavity 174 reaches infra-red sensitive surface 176 of detector element 32. Thus, detector element 32 is directed downwardly at an angle in the range of from about 5° to about 10°,preferably about 7°, below horizontal. This downward angle reduces the likelihood of ambient radiation, such as sunlight, reaching detector element 32. Transmitter module 160 is preferably mounted at an angle, with respect to the mounting of detector 162, in the order of about 5°, so that the transmitter module is downwardly sloped less than is the detector module, being directed in the range of from approximately horizontal to about 5° below horizontal, preferably 2° below. This directs radiation beam 34 in the optimum direction not only for reflection by a vehicle parked in the controlled parking space but also for defraction through junction 180. Preferably, housing 140 is mounted on pole 132 at a point in the order of about 25 inches above the street level and pole 132 is adjacent one end of the controlled parking space with the center of unfocussed radiation beam 34 pointed to a spot about four feet from the opposite end of the parking space.

Transmitter element 30 is mounted on a printed circuit board 186 which is slidably positioned within a cavity 188 in transmitter module 160 and which also mounts the remaining circuitry of transmitter circuit 40. Eyelet 190 has its shaft connected to printed circuit board 186 with its loop 191 positioned in front of module 160. Adjustment rod 192 has one of its ends extending through the loop of eyelet 190 and its other end connected to the shaft of an adjustment screw 194 which threadedly engages an opening 196 through one side of housing 140 as depicted in FIG. 6. As adjustment screw 194 is rotated clockwise or counterclockwise, rod 192 pivots toward or away from transmitter window 166, as depicted by positions **192*a* and 192*b* in FIG. 8. This pivoting of rod 192 results in pulling or pushing of eyelet 190, and thus of printed circuit board 186, further out from or into cavity 188, adjusting the size and intensity of light beam 34, thereby permitting control of the sensitivity of the reset circuit. This adjustability, together with the use of three LEDs as transmitter element 30, results in radiation beam 34 not being sharply focused, improving the response of the reset device since detection element 32 need not be in the path of a precisely focused reflected radiation beam. By way of example, operation of adjustment screw 194 might permit positioning of the LEDs at positions in the range of from about 0.3 inch to about 0.42 inch from the inner surface of transmitter window 166**.

During normal operation, radiation from transmitter element 30 enters transmitter window 166. A portion of the transmitted radiation is defracted to junction 180 to enter detector window 168. This defracted radiation is again defracted, with a part of it passing through opening 172 and cavity 174 to detector element 32 and a part of it passing out of window 168 toward the parking space. Under normal conditions the amount of this defracted radiation thus reaching detector element 32 is insufficient to prevent actuation of control circuit 46. Consequently, if there is no vehicle parked in the controlled parking space, the parking meter is reset. However, if there is a vehicle parked in the space, the radiation reflected from the vehicle which passes through detector window 168, opening 172 and cavity 174 to detector element 32 prevents actuation of the control circuit. If an object is blocking transmitter window 166, then much of the radiation which ordinarily would be transmitted toward the controlled parking space is reflected by the object back toward transmitter module 160 which re-reflects it into transmitter window 166. As a result of such repeated reflection, an increased amount of the radiation is refracted through junction 180 and into detector window 168, increasing the amount of refracted radiation reaching detector element 32 to an amount preventing actuation of control circuit 46. Likewise, if detector window 168 is blocked, refracted radiation directed from transmitter window 166 through detector window 168 towards the parking space is reflected by the object blocking the detector window toward detector element 32, and so an increased amount of radiation reaches detector element 32, again preventing actuation of control circuit 46. Likewise, if both windows 166 and 168 are blocked, sufficient radiation reaches detector element 32 to prevent actuation of control circuit 46. Consequently, if either transmitter window 166 or detector window 168, or both, are blocked, parking meter 16 operates as a non-resettable parking meter, assuring that a parked vehicle is not undeservedly charged with an unpaid parking violation.

Although the present invention has been described with reference to preferred embodiments, various modifications and rearrangements can be made, and the results would still be within the scope of the invention.

I claim:

1. A parking meter reset device adapted for use with a parking meter mounted on a parking meter pole to control the allocation of parking time for parking of a vehicle in an associated parking space, the parking meter including an unpaid time indicator, a timer for timing a preselected period of paid time for a vehicle to remain parked in the associated parking space, and a coin responsive actuator for deactuating the unpaid time indicator and actuating the timer for a period of paid time selected in accordance with the coins utilized to initiate operation of the actuator, following which the unpaid time indicator is actuated, said parking meter reset device comprising:

a housing adapted for mounting on a parking meter pole;

an infra-red radiation transmitter mounted within said housing for transmitting infra-red radiation toward an associated parking space in a direction generally below horizontal;

an infra-red radiation detector mounted within said housing for detecting infra-red radiation from said transmitter after reflection thereof from a vehicle parked in the associated parking space; and a controller connected to said detector and responsive to passage of a predetermined time interval without said detector detecting infra-red radiation of at least a predetermined level for providing an output signal for application to a parking meter to actuate an unpaid time indicator within the parking meter a said housing including a first window member positioned adjacent said transmitter for passage therethrough of radiation transmitted from said transmitter toward the associated parking space and a second window member positioned adjacent said detector for passage therethrough of radiation reflected from the vehicle, said second window member having an edge abutting an edge of said first window member for passage thereinto of radiation from said transmitter entering said first window member and refracted to said first window member edge, at least a portion of the last-named radiation being refracted within said second window member toward said radiation detector.

2. A parking meter reset device as claimed in claim 1 wherein said infra-red radiation detector comprises:

a detector module having a front surface facing said second window member with a cavity extending from said front surface into said detector module; and an infra-red radiation detector element positioned within said cavity and having an infra-red radiation sensitive surface exposed to said second window member for detection of infra-red radiation passing from said second window through said cavity.

3. A parking meter reset device as claimed in claim 2 wherein said detector element is positioned within said cavity with said infra-red sensitive surface spaced from said second window member by a distance in the order of about 0.7 inch.

4. A parking meter reset device as claimed in claim 1 wherein said infra-red radiation transmitter comprises:

a transmitter module having a front surface facing said first window member with an opening extending from said front surface into said transmitter module;

an infra-red transmitter element positioned within said opening for transmission of infra-red radiation through said first window member.

5. A parking meter reset device as claimed in claim 4 wherein said infra-red transmitter element comprises a plurality of infra-red transmission devices for transmitting infra-red radiation in an unfocussed beam.

6. A parking meter reset device as claimed in claim 4 wherein said infra-red radiation transmitter further comprises means for adjusting the position of said transmitter element within said opening and so adjusting the spacing of said transmitter element from said first window member.

7. A parking meter reset device as claimed in claim 6 wherein said adjusting means includes means for adjusting the position of said transmitter element to adjust the spacing between said transmitter element from said first window member over the range of from about 0.3 inch to about 0.42 inch.

8. A parking meter reset device as claimed in claim 1 wherein said infra-red radiation detector is positioned for detection of infra-red radiation from a general direction in the range of from about 5° to about 10° below horizontal when said housing is mounted on a vertical parking meter pole.

9. A parking meter reset device as claimed in claim 8 wherein the general direction is about 7° below horizontal.

10. A parking meter reset device as claimed in claim 8 wherein said infra-red radiation transmitter is positioned for transmission of infra-red radiation in a general direction in the order of about 5° above the general direction of detection by said infra-red radiation detector.

11. A parking meter reset device as claimed in claim 1 wherein said first window member includes an edge abutting an edge of said second window member for permitting radiation refracted by said first window member to pass through said edges into said second window member for further refraction.

12. A parking meter reset device as claimed in claim 11 wherein said first and second window members have a thickness in the range of from about 0.1 mm to about 8 mm.

13. A parking meter reset device as claimed in claim 1 wherein:

said device further comprises a timing circuit for generating timing pulses of a first duration at pulse intervals of a second duration;

said infra-red radiation transmitter is responsive to timing pulses from said timing circuit for transmitting a pulse of infra-red radiation toward the associated parking space;

said infra-red radiation detector is responsive to timing pulses from said timing circuit for enabling said detector to receive the transmitted pulse of infra-red radiation after reflection thereof from a vehicle parked in the associated parking space; and said device further comprises a controller connected to said infra-red radiation detector for actuating the parking meter unpaid time indicator and for terminating operation of the parking meter timer in response to passage of a time interval greater than the second duration without said infra-red radiation detector detecting infra-red radiation, whereby said infra-red radiation transmitter and detector require current only during timing pulses, thereby minimizing power requirements and prolonging battery life.

14. A parking meter reset device as claimed in claim 13 wherein said timing circuit generates timing pulses having a duration in the order of about 100 milliseconds at a pulse interval in the order of about 30 seconds.

15. A parking meter reset device as claimed in claim 13 further comprising an optical coupler for electrically isolating said transmitter from said detector.

* * * * *